US007353639B2

(12) United States Patent
Carson

(10) Patent No.: US 7,353,639 B2
(45) Date of Patent: Apr. 8, 2008

(54) RECREATIONAL VEHICLE PORTABLE DECK

(76) Inventor: Sonny Carson, 18155-CR 1108, Flint, TX (US) 75762

( * ) Notice: Subject to any disclaimer, the term of this patent is extended or adjusted under 35 U.S.C. 154(b) by 125 days.

(21) Appl. No.: 10/272,056

(22) Filed: Oct. 16, 2002

(65) Prior Publication Data

US 2004/0200159 A1 Oct. 14, 2004

(51) Int. Cl.
*E04B 5/23* (2006.01)
*E04H 1/00* (2006.01)

(52) U.S. Cl. ..... 52/79.5; 52/79.6; 52/126.1; 52/653.1

(58) Field of Classification Search ..... 52/79.6, 52/79.5, 126.1, 650.3, 653.1
See application file for complete search history.

(56) References Cited

U.S. PATENT DOCUMENTS 2,929,654 A 3/1960 Jones
3,515,406 A 6/1970 Endsley, Jr.
3,608,951 A 9/1971 Jackson
3,750,351 A * 8/1973 Greenburg ..... 52/64
3,808,757 A * 5/1974 Greenwood ..... 52/184
3,841,036 A 10/1974 Johnson
4,347,638 A 9/1982 Weaver
4,468,901 A * 9/1984 Henderson et al. ..... 52/79.6
4,691,484 A * 9/1987 Wilson ..... 52/79.6
4,747,243 A * 5/1988 Anstead ..... 52/184
4,759,162 A * 7/1988 Wyse ..... 52/126.6
5,152,109 A * 10/1992 Boers ..... 52/143
5,660,121 A * 8/1997 Botts et al. ..... 108/132
6,082,070 A * 7/2000 Jen ..... 52/650.3
6,427,403 B1 * 8/2002 Tambakis ..... 52/309.1

FOREIGN PATENT DOCUMENTS

DE 3617020 A1 * 11/1987
JP 2000234382 A * 8/2000

* cited by examiner

*Primary Examiner*—Joe Edell

(57) ABSTRACT

The present invention is a free standing portable deck for use with recreational vehicles. The deck further comprises a polygonal shape lower support frame. The support frame further comprises a plurality of removably interconnected rails. A flat planar platform portion is being removably mounted upon the lower support frame. A plurality of leg members are being disposed underneath the lower support frame at each corner such that the platform portion is held in a substantially level position at a predetermined height in relation to the recreational vehicle door. Each leg member is removably connected to each corner of the lower support frame. The upper support frame is removably connected to the lower support frame and extends linearly upward. At least one step means provides for ingressing and regressing onto the platform portion. The at least one step means is located at a predetermined distance from the lower support frame and at a predetermined height in relation to the ground level. The upper support frame forms a partial enclosure of the platform portion. Disassembly means is provided for completely disconnecting the deck for easy storage.

21 Claims, 15 Drawing Sheets

RECREATIONAL VEHICLE PORTABLE DECK

BACKGROUND

The present invention relates to decks and more particularly the present invention relates to portable decks for recreational vehicles.

The use of portable decks for recreational vehicles is known in the prior art. The decks disclosed in the prior arts deal with portable decks which primarily attach to the underside of the recreational vehicle. The known prior art include U.S. Pat. Nos. 4,691,484, 4,747,243, and 5,417,468.

The present invention relates to a free standing portable deck which can be fully disassembled. While inventors in the past have directed their efforts toward creating collapsible decks which might be easily stored, none of the prior art of which applicant is aware discloses a portable deck with the unique features taught by the present invention.

SUMMARY

The present invention provides a free standing portable deck for use with recreational vehicles. The deck further comprises an assembled base frame defined by a plurality of individually adjustable ground engaging elongated leg members and a plurality of individually adjustable shorter ground engaging leg members. Each leg members is removably interlocked with a plurality of elongated rail members forming a lower support frame structure having a polygonal shape external perimeter frame with a predefined number of corners. The lower support frame structure is adapted to receive a flat planar platform portion.

Each shorter leg member has a first corner angle male coupling means fixably attached to its upper end. Each elongated leg member has a second corner angle male coupling means attached to its distal end. The second corner angle is fixably attached to each elongated leg member at a position equivalent to the height of each shorter leg member. Each corner angle of the first and second male coupling means are dimensioned according to its corresponding corner angle in the polygonal shape of the external perimeter frame.

Each rail member in the external perimeter frame has a female coupling means incorporated at each opposite end. Each female coupling means is removably interlocked with its corresponding male coupling means such that the polygonal shape of the external perimeter frame is formed.

The deck of the present invention further comprises an upper support frame defined by a plurality of vertical rails, a banister structural member and a plurality of rail support panels. Each vertical rail is perpendicularly coupled to the external perimeter frame at a strategic location in parallel relation to its corresponding elongated leg member. Each vertical rail member and its corresponding elongated leg member extend linearly upward to a fixed length forming a plurality of upright structural beams.

The deck of the present invention further comprises the banister member having a partially enclosed polygonal shape corresponding to the shape of external perimeter frame. Each corner of the banister structural member is adapted to be removably coupled to the upper end of each structural beam wherein the entire deck is securely and fixably held in place.

In the present invention, each rail support panel is disposed between two structural beams with each rail support panel being removeably connected at a substantially mid-point between the two structural beams. When connected to the assembled base frame, the upper support frame forms a partial enclosure of the platform portion leaving a frontal opening for ingressing and egressing into the door of the recreational vehicle and at least one side opening.

The deck of the present invention further comprises at least one step means for ingressing and egressing onto the platform portion. The at least one step means is removably coupled to the at least one side opening in the external perimeter frame. Finally, each element of the deck of the present invention can be easily disassembled for storage in the trunk of a car.

BRIEF DESCRIPTION OF DRAWINGS

FIG. 2A illustrates the assembled base frame dissecting into 4 receiving channels.

DETAILED SPECIFICATION

Figure 1:
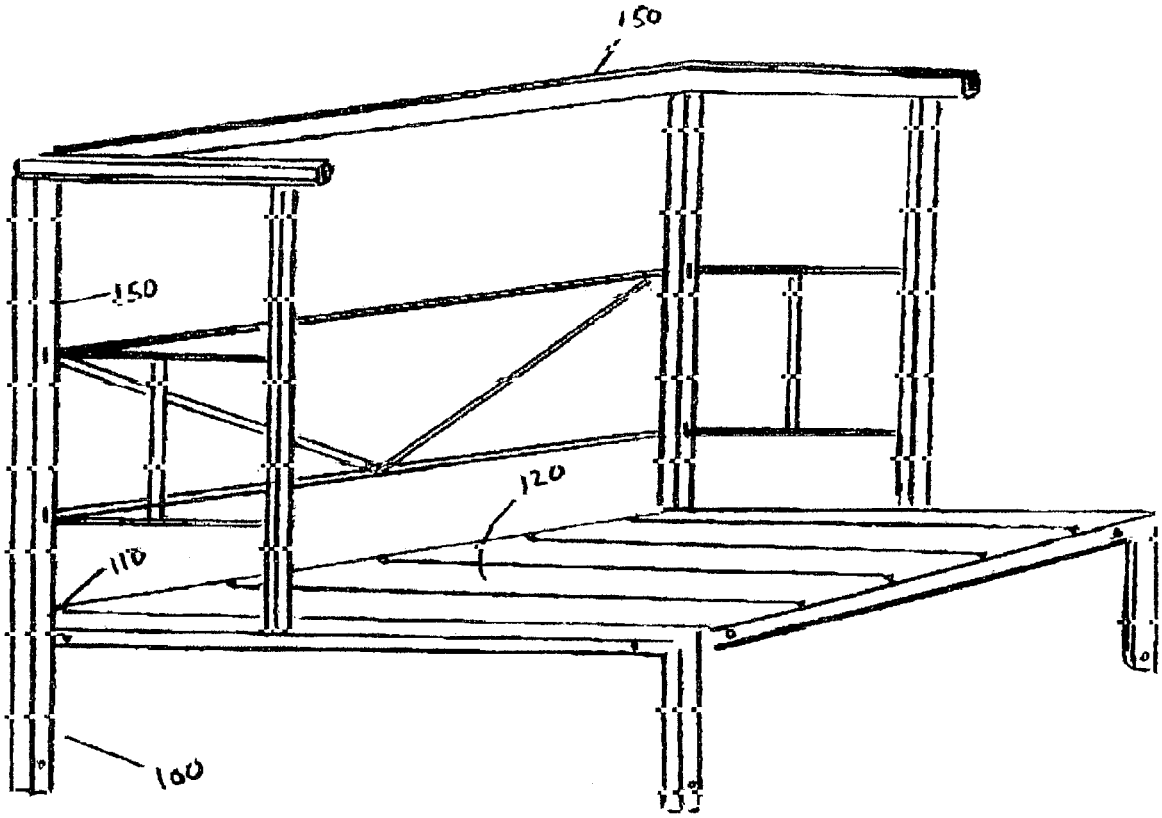
FIG. 1 illustrates a full perspective of the invention aligned next to a recreational vehicle.

Referring initially to FIG. 1, there is shown a perspective view of one embodiment of the present invention, a fully assembled portable deck (100) for use with recreational vehicles. As shown in FIG. 1, the deck (100) is free standing and is aligned adjacent to the steps of the recreational vehicle to allow ingress and egress from the door of the recreational vehicle. The deck (100) further includes a platform portion (120) supported by a rigid assembled base frame structure (110), which is removablely coupled to the upper support frame structure (150). The upper support frame (150) and base frame (110) can be made of steel or another such compatible metal or material.

Figure 2:
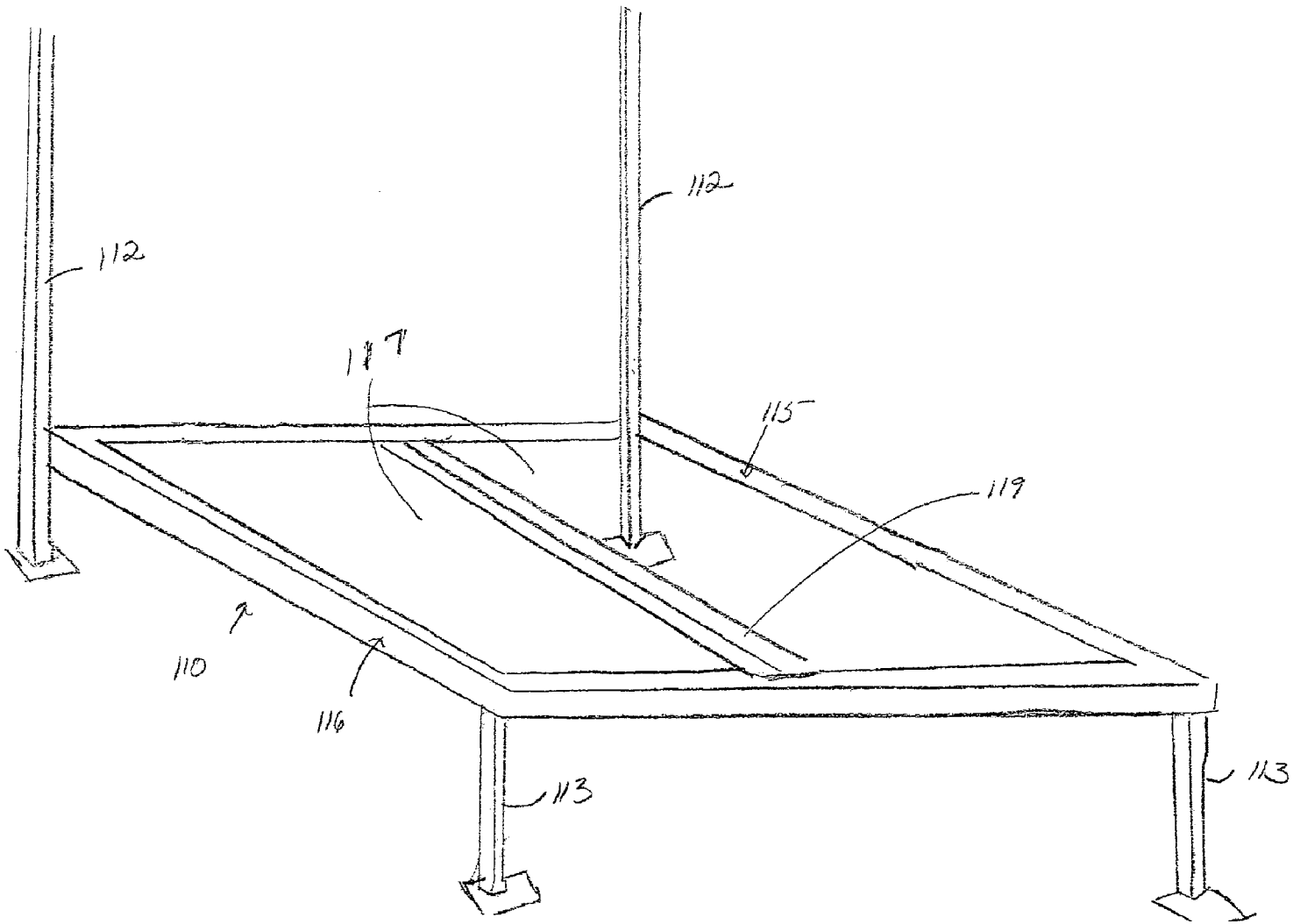
FIG. 2 illustrates an exploded front view of the assembled base frame.

FIG. 2 illustrates an exploded view of the assembled base frame (110) structure of deck (100). The assembled base frame (110) is defined by a plurality of individually adjustable ground engaging elongated leg members (112) and a plurality of individually adjustable shorter ground engaging leg members (113). As shown, the shorter leg members (113) and elongated leg members (112) are removably interlocked with a plurality of elongated rail members to form lower support frame structure (115). To form the external perimeter frame (116) of the lower support frame structure (115), the leg members (112, 113) are slideably coupled to a subset of the rail members. In the illustrated embodiment, the external perimeter frame (116) is assembled into a polygonal shape with a predefined number of corners. Then, each rail member of the external perimeter frame (116) is securely bolted in place with a removable threaded fastener. To form the internal frame (119) of the lower support structure (115) another subset of the elongated rail members is removably disposed within the external perimeter frame (116). The internal frame (119) dissects the external perimeter frame (116) into a plurality of receiving channels (117). In the illustrated embodiment of the present invention shown in FIG. 2, the external perimeter frame (116) has a rectangular shape and is dissected into two receiving channels (117). As illustrated in FIG. 2A, in alternative embodiments of the present invention, the external perimeter frame (116) can be dissected into four receiving channels (117).

Figure 3A:
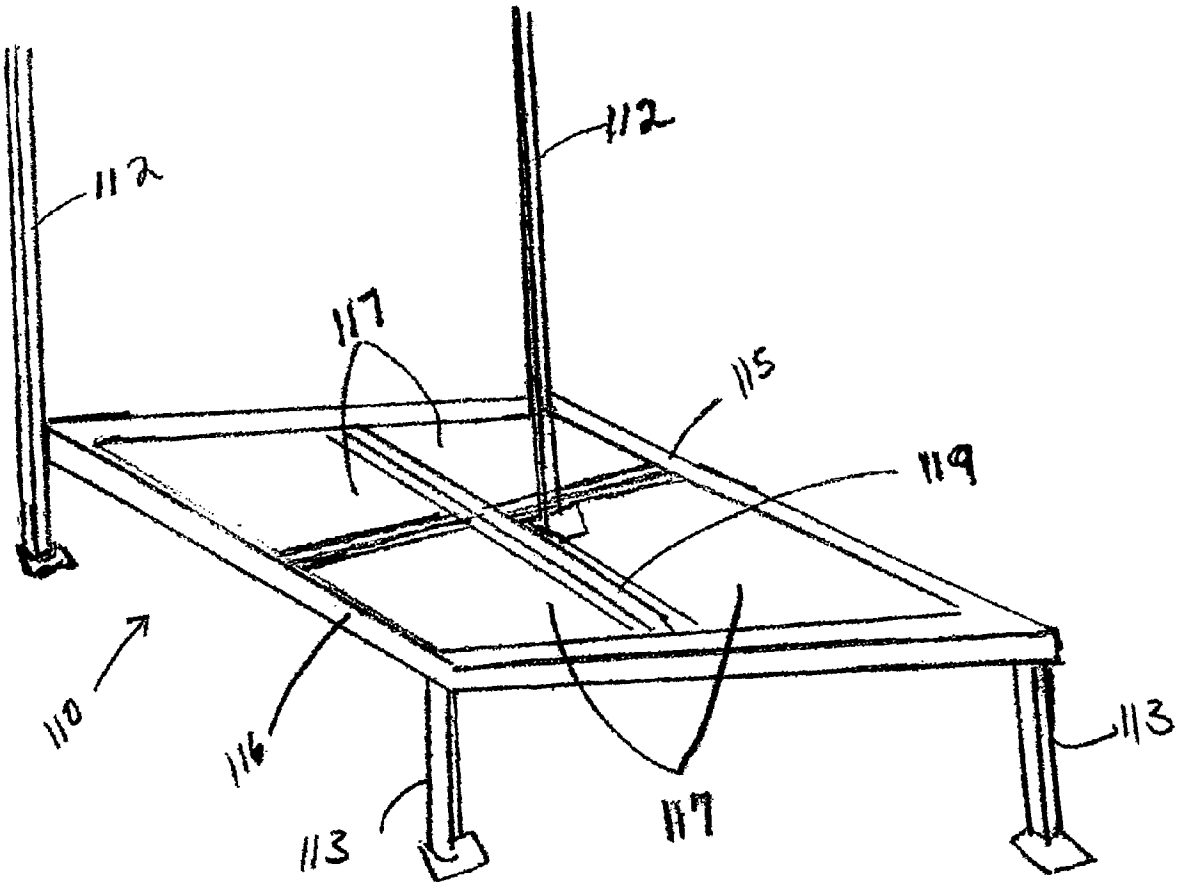
FIG. 3 and FIG. 3A illustrates an exploded side view of the adjustable leg member of the deck of the present invention.
Figure 3:
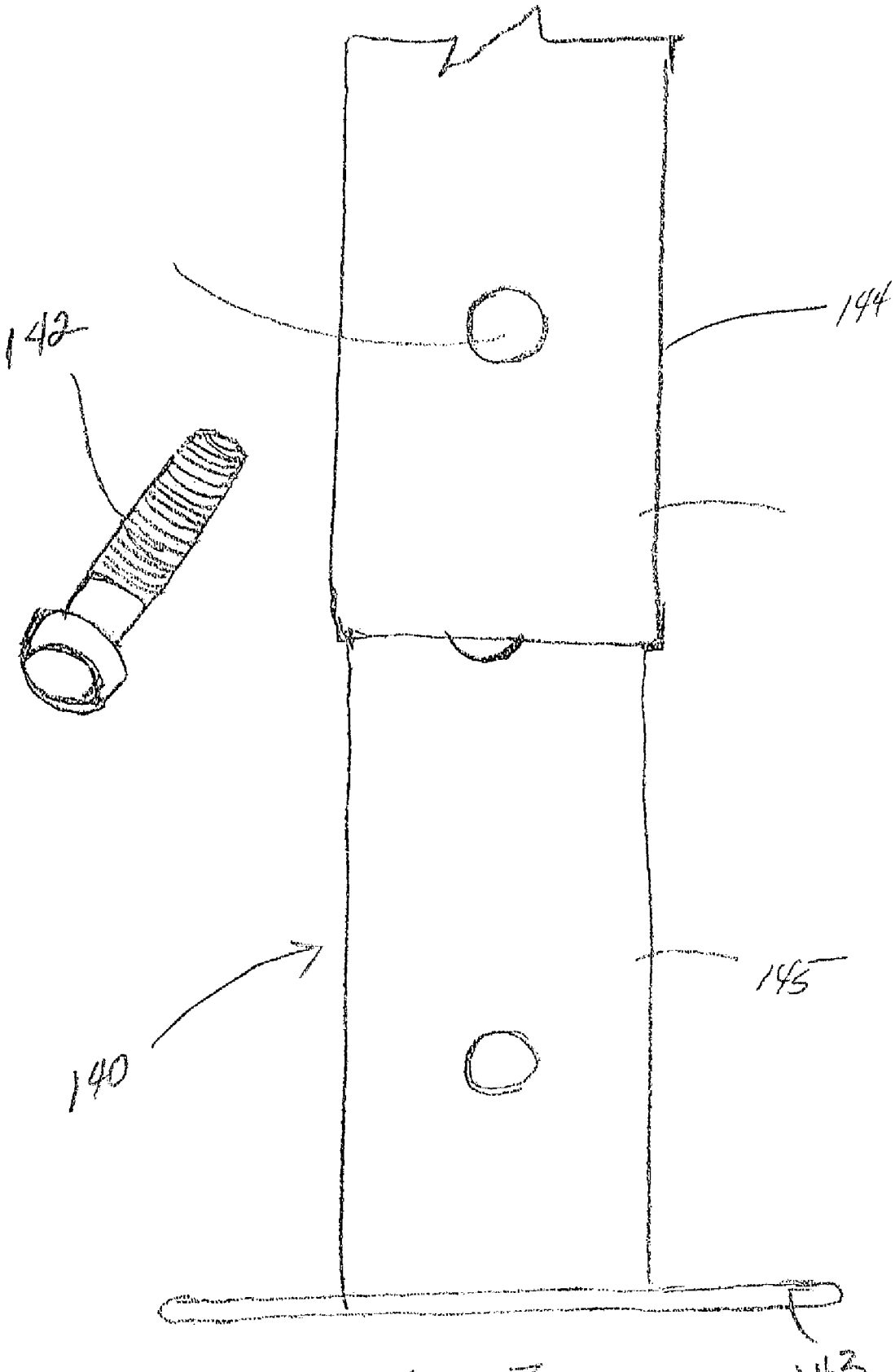
Figure 3A:
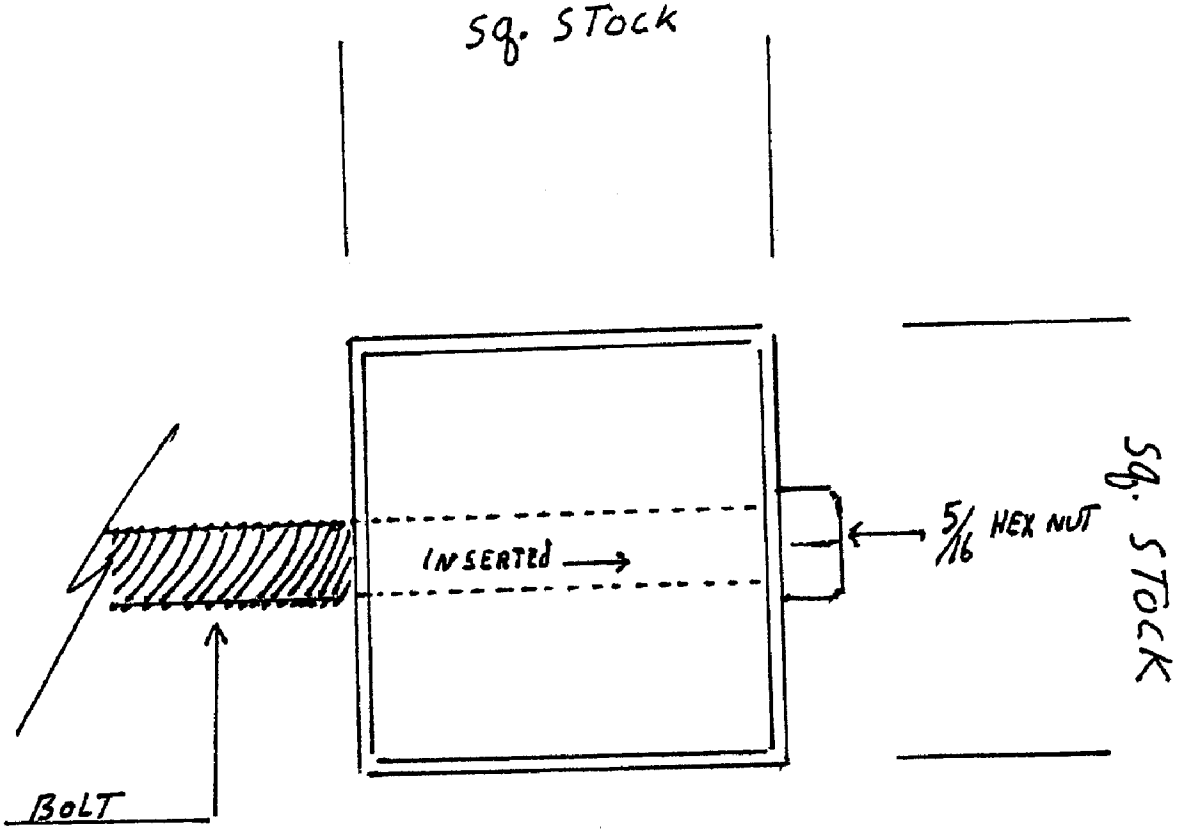

Each ground engaging leg member (112, 113) of deck (100) shown in FIG. 1 is individually adjustable. Referring now to FIG. 3, there is shown an exploded view of the adjustable leg member (140). The adjustable leg member (140) further comprises a slidable rail having an upper portion (144) and a lower portion (145). The upper portion (144) is adapted to telescope onto the lower portion (145). The upper portion (144) is adjusted up or down into a set position such that the lower support frame (115) is held at a height in relation to the ground level. A locking mechanism is used to securely hold the upper portion (144) and the lower portion (145) at a particular height. As illustrated, the locking mechanism further consists of a column of bores located along the midpoint of the longitudinal axis of the leg member (140). As shown in FIG. 3A, to secure the leg member (140) in place at a specific height, a threaded fastener bolt (142) is inserted into the appropriate bore. At the far end of each lower portion (144) is a ground-engaging member (143) to support each leg member.

Figure 4:
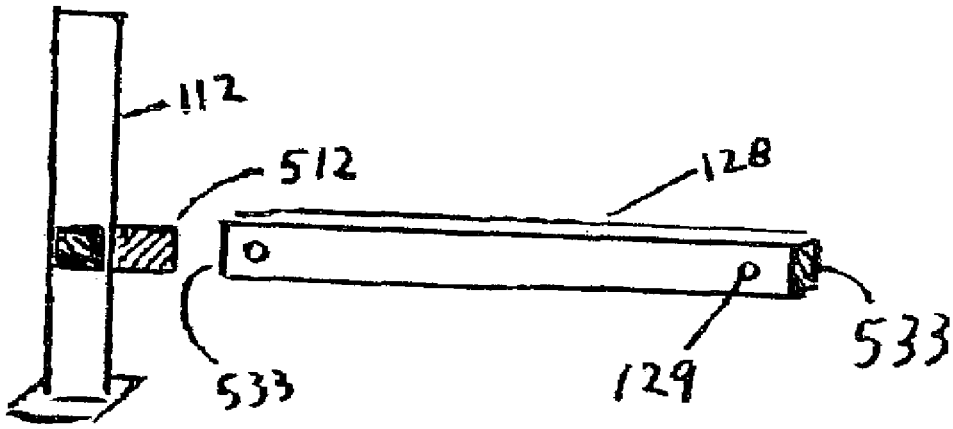
FIG. 4 is an exploded side view of an elongated leg member.
Figure 4A:
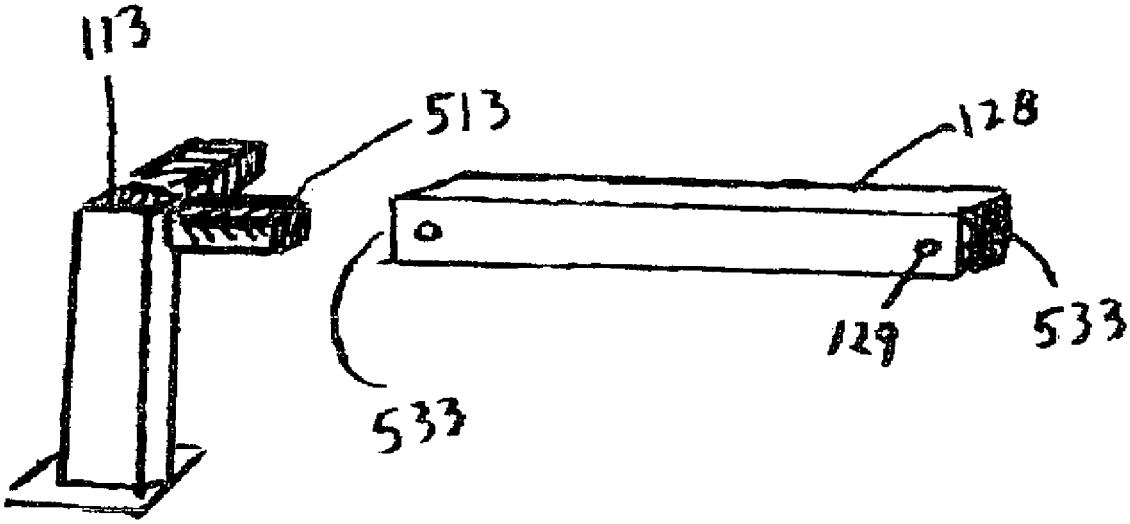
FIG. 4A is an exploded side view of a shorter leg member.

Referring now to FIGS. 4 and 4A, there is shown an exploded view of each leg member (112, 113). In the illustrated embodiment, each shorter leg member (113) has a first corner angle male coupling means (513) fixably attached to its upper end, and each longer leg member (112) has a second corner angle male coupling means fixably attached to its distal end. The first male coupling means (513) and the second male coupling means (512) are dimensioned according to its corresponding corner angle in the polygonal shape of the external perimeter frame of the lower support frame structure. In the embodiment shown in FIG. 1, the external perimeter frame (116) is rectangular with four corner right angles. To form each male coupling means (512, 513) illustrated in FIGS. 4 and 4A, two short protruding rods are securely connected together to form each corner right angle. As shown, with each shorter leg member (113), the first male coupling means (513) is fixably attached to the upper end of each shorter leg member (113). However, with each elongated leg member (112), the two protruding rods of each second corner male coupling means (512) is integrated into the structure of each elongated leg member (112) at its distal end. As shown in the illustrated embodiment, the second corner male coupling means (512) is integrated at a position equivalent to the height of each shorter leg member (113).

The lower support frame structure further comprises each rail member (128) in the external perimeter frame (116) having a female coupling means (533) disposed at each opposite end. In the illustrated embodiment, the female coupling means (533) is formed from an internal bore disposed at each opposite end. Each internal bore is dimensioned to fit a protruding rod of a matching male coupling means (512, 513). To form the shape of the external perimeter frame (116) each female coupling means (533) is slideably coupled to its matching male coupling means (512, 513). Then, each rail member (128) is secured to male coupling means (512, 513) by a threaded bolt fastener (129).

Referring back to FIG. 1, deck (100) further includes a flat planar platform portion (120) being removably mounted upon the lower support frame (115). In the illustrated embodiment, the platform portion (120) is further defined by a plurality of side-by-side panels (122) disposed across the width of lower support frame (115). As shown, the outer peripheral edges of each panel is adapted to interlock with its adjacent panel such that the panels are prevented from spreading apart and form a smooth flat continuous surface. The assembling process of the panels (122) requires no pins or bolts. The panels can be made of wood, metallic mesh, plastic, or other such compatible material.

Figure 5:
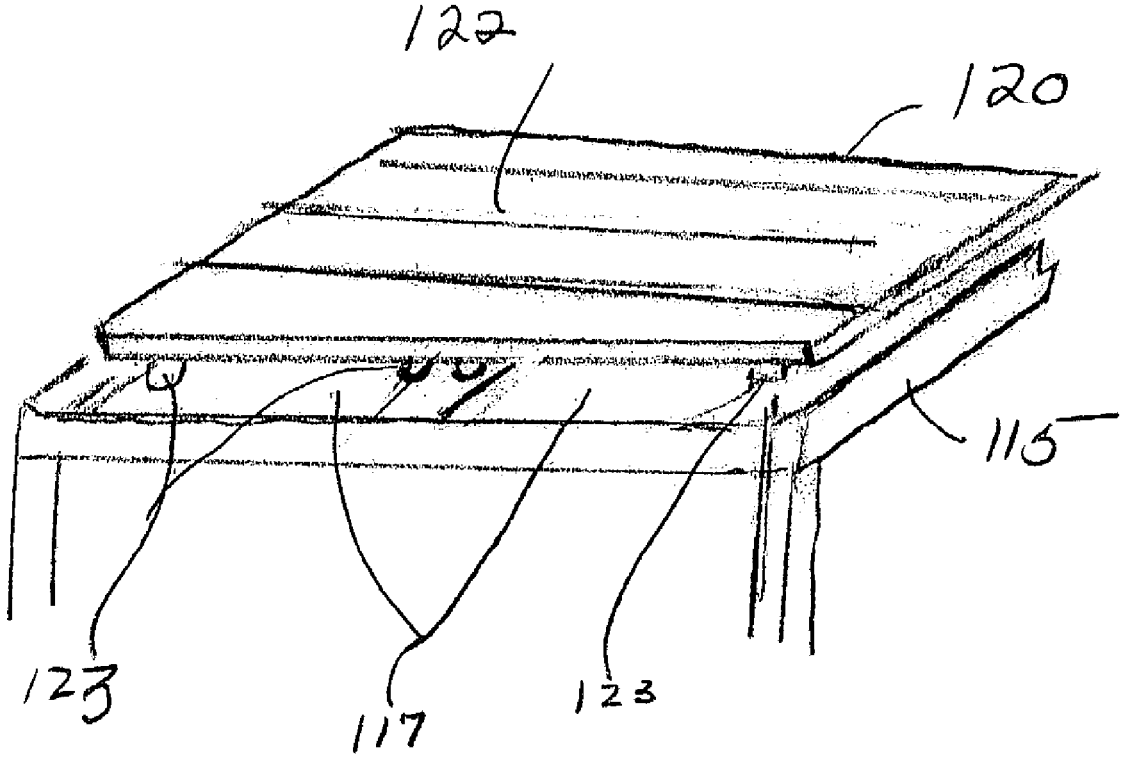
FIG. 5 is an exploded to view of the platform portion being mounted upon the lower support frame structure.

Referring to FIG. 5, there is shown an exploded view of the platform portion (120) being mounted upon the lower support frame structure (115). In the illustrated embodiment, each panel (122) has a plurality of holding guide struts (123) attached to its underside. The holding guide struts (123) are positioned and dimensioned for insertion into the receiving channels (117) of the lower support frame structure (115). In the illustrated embodiment, the external perimeter frame (116) is dissected into two receiving channels (117) by the internal frame (127). When mounted in the receiving channels (117), the outer peripheral edges of each panel (122) is removably interlock with the outer peripheral edges of its adjoining panel to form a secure flat continuous planar surface.

Figure 6:
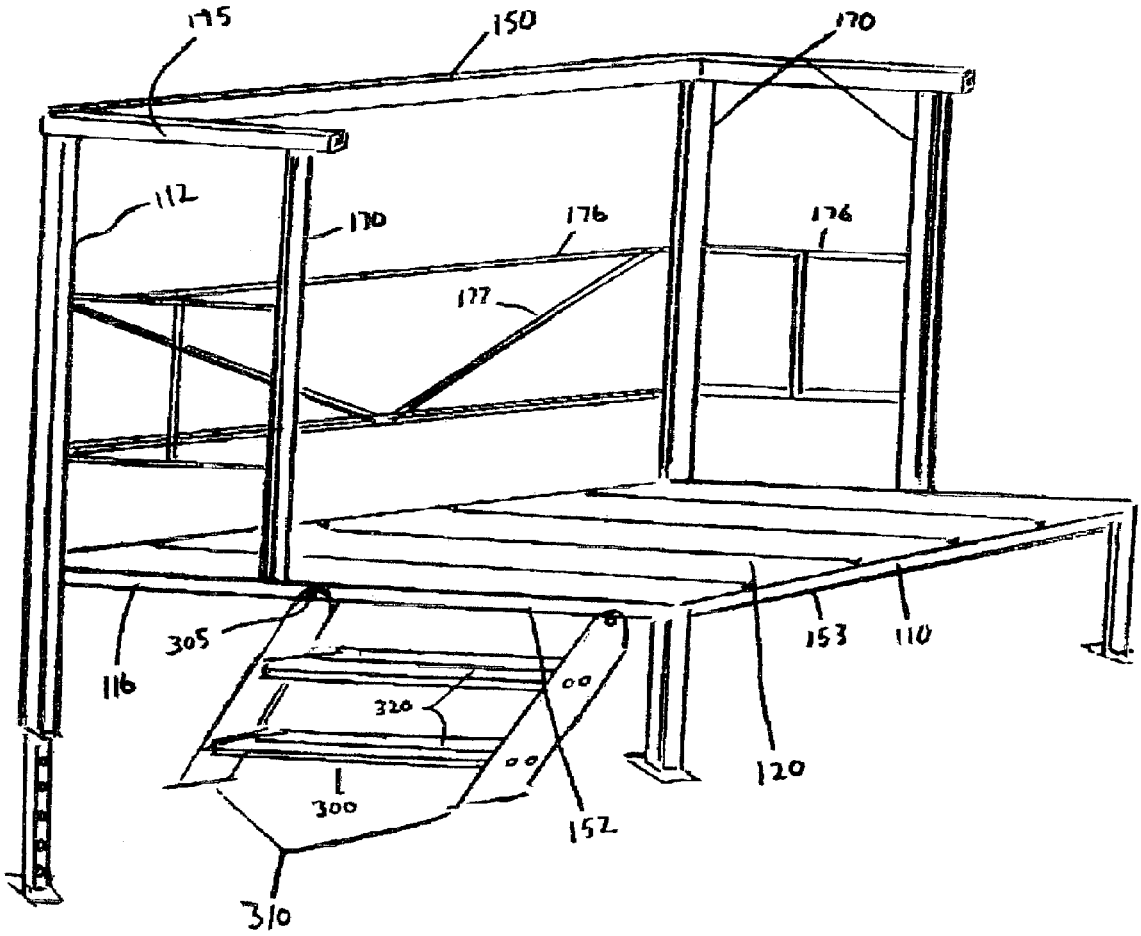
FIG. 6 is the preferred embodiment of the present invention illustrating the upper support frame connected to the assembled base frame.

Referring to FIG. 6, deck (100) further includes an upper support frame (150) being removably connected to the assembled base frame (110). The upper support frame (150) extends linearly upward to a predetermined height forming a partial enclosure of the platform portion (120). In forming the partial enclosure around the platform portion (120) at least two openings are provided. The first opening (152) is for ingressing and egressing onto the at least one step means which is described in detail below. A second opening (153) is provided for ingressing and egressing into the door of the recreational vehicle.

In the illustrated embodiment, the upper support frame (150) further comprises a plurality of elongated vertical rails (170), a banister structural member (175), and a plurality of rail support panels (176). Each vertical rail member (170) is removably coupled to the external perimeter frame (116) of the lower support frame (115) at strategic location in a perpendicular position in parallel relation to its corresponding elongated leg member (112). As shown, each vertical rail member (170) and its corresponding elongated leg member (112) extend linearly upward to a fixed length to form a plurality of structural vertical beams.

Figure 6A:
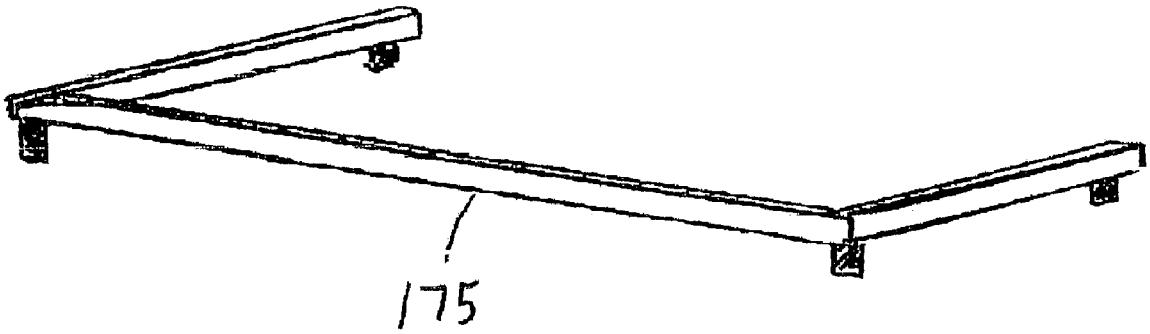
FIG. 6A is the front view of the banister member of the upper support frame.

In the illustrated embodiment, the banister structural member (175) is removably coupled to the upper end of each structural vertical beam (112, 170). Referring to FIG. 6A, there is shown an exploded frontal view of the banister structural member (175). In the illustrated embodiment, the banister structural member (175) forms a partial rectangle with protruding rods at each corner. Each rod is adapted to be slidably coupled to a matching structural vertical beam (112, 170). When the banister structural member (175) is coupled to each structural vertical beam (112, 170), the entire deck becomes sturdy and is securely held in place.

To form the partial enclosure of the platform portion (120), each rail support panel (176) is disposed between two supporting vertical beams (170). Each rail support panel (176) is removeably connected at a substantially midpoint between two vertical structural beams utilizing threaded bolt fasteners. In the illustrated embodiment, each rail support panel (176) further comprises a plurality of beams (177) fixably connected into a pattern arrangement. To support the partial enclosure of the platform portion (120), each rail support panel is configured with a predefined width and with a predefine length corresponding to the distance between the two supporting vertical structural beams (170, 112).

Figure 8:
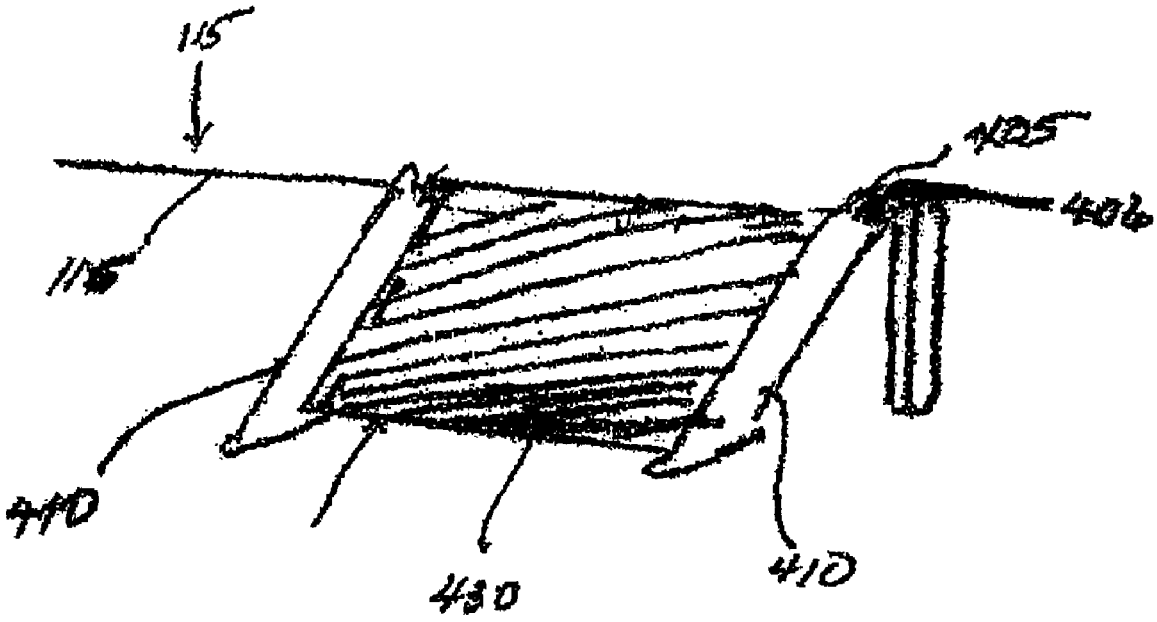
FIG. 8 is an exploded side view of the handicap step member means.

Deck (100) of the present invention further includes a step member for ingressing and egressing onto the platform portion. Referring to FIG. 6, in the preferred embodiment of the present invention, step member (300) is connected to the external perimeter frame (116) of lower frame structure (115). In some embodiments, step member (200) is disconnected from the external perimeter frame (115) as shown in FIG. 1. Yet, in other embodiments, deck (100) further includes at least handicap step member means (400) as shown in FIG. 8.

Figure 7:
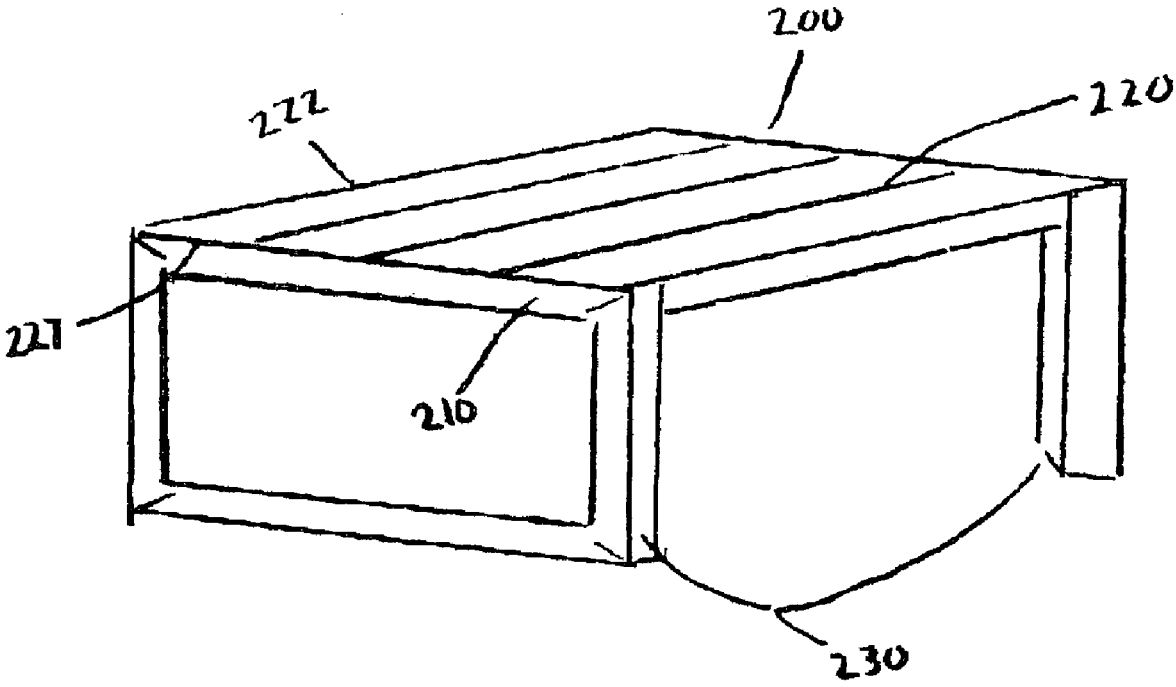
FIG. 7 and FIG. 7A are exploded front view of the step means of the present invention.

Referring to FIG. 7, there is shown an exploded view of the disconnected step member means (200) illustrated in FIG. 1. In the illustrated embodiment, the step means (200) further comprises a second lower support frame (210) having a polygonal shape in the form of a rectangle. Second lower support frame (210) further comprises a plurality of elongated rails that are adapted to interconnect into the polygonal shape of the second lower support frame (210). In the illustrated embodiment, the lower support frame (210) further comprises four interconnected elongated rails. To support the illustrated embodiment, the ends (213) of the two side rails are adapted to be slidably and securely coupled into the adjacent ends (214) of the two attached front rails. The rails can be made of steel or another such compatible metal or material.

The illustrated embodiment in FIG. 7 further includes a flat planar second platform portion (220) being removably mounted upon the second lower support frame (210). In the illustrated embodiment, the second platform portion (220) is further defined by a plurality of side-by-side panels disposed across the width of second lower support frame (210). The interior edges of second lower support frame (210) are equipped a channel (227) for receiving the outer peripheral edges (222) of each panel. The inner peripheral edges of each panel are equipped with means for interlocking with the inner edges of the adjoining panel. As shown, the panels are mounted such that the panels are prevented from spreading apart and are aligned next to each other to form a smooth flat surface. The assembling process of the panels requires no pins or bolts. The panels can be made of wood, plastic, or other such compatible material.

Figure 7A:
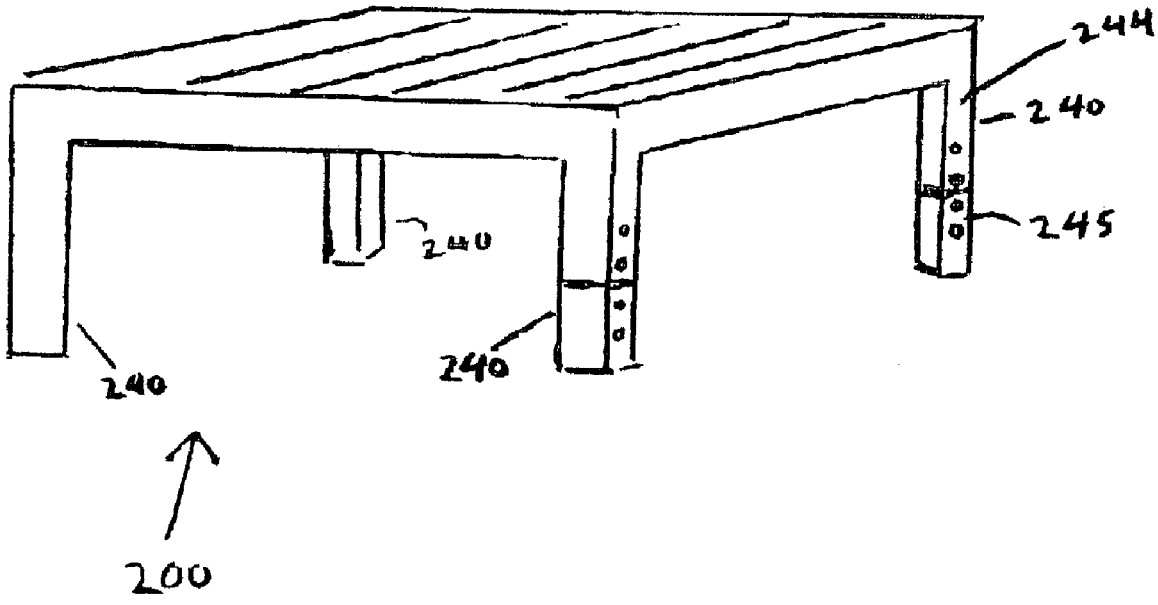
Figure 7B:
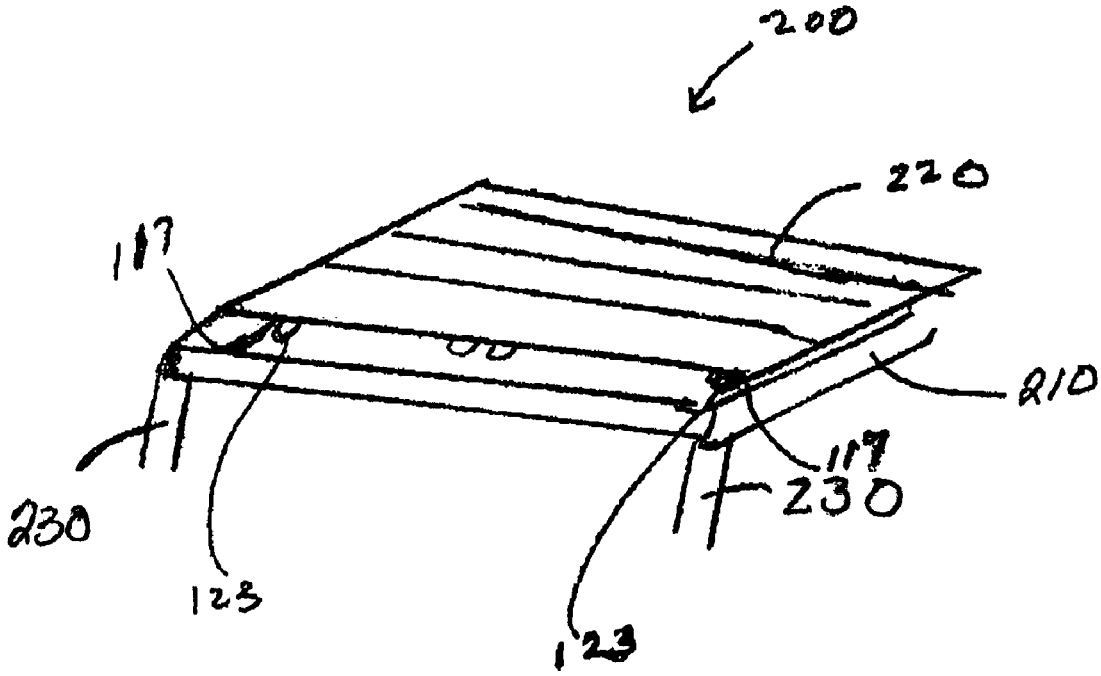
FIG. 7B illustrates the struts attached to the underside of step means of the present invention.

Referring to FIG. 7B, there is shown an exploded view of the second platform portion (220) being mounted upon the second lower support frame structure (210). In the illustrated embodiment, each panel of platform portion (220) has a plurality of holding guide struts (123) attached to its underside. The holding guide struts (123) are positioned and dimensioned for insertion into the receiving channels (117) of the second lower support frame structure (210).

The step means (200) illustrated in FIG. 7 further includes a plurality of leg members (230) to support the weight of the second lower support frame (210). The number of leg members corresponds to the number of corners in the polygonal shape of the second lower support frame (210). Four leg support members (230) are required to support the illustrated embodiment. In the illustrated embodiment each leg member (230) is disposed underneath the second lower support frame (210) at each corner. Each leg member (230) is removable coupled to each corner such that the second platform portion (220) is held in a substantially level position at a predetermined height in relation to the ground level.

In some specific embodiments of deck (100) each second leg member (240) of step means (200) can be individually adjustable as shown in FIG. 7A. Each second adjustable leg member (240) further comprises a slidable rail having an upper portion (244) and a lower portion (245). The upper portion (244) is adapted to telescope onto the lower portion (245). The upper portion (244) is adjusted up or down into a set position such that the second lower support frame is held at a height in relation to the ground level. A locking mechanism is used to securely hold the upper portion (244) and the lower portion (245) at a particular height. As illustrated, the locking mechanism further consists of a column of bores located along the midpoint of the longitudinal axis of the leg member. To secure the leg member in place at a specific height, a bolt is inserted into the appropriate bore. At the far end of each lower portion (244), is a ground-engaging member (246) to support the each second leg member (240).

Referring back to the illustrated embodiment in FIG. 1 step means (200) is disconnected from the lower support frame (115). Additionally, a second detached step means could be placed on the opposite side of lower support frame (115) at third opening (235). The deck (100) of the present invention can have a plurality of step means strategically placed around lower support frame (115). However, to support each additional step means, an additional opening will be required within the upper support frame structure.

Figure 6B:
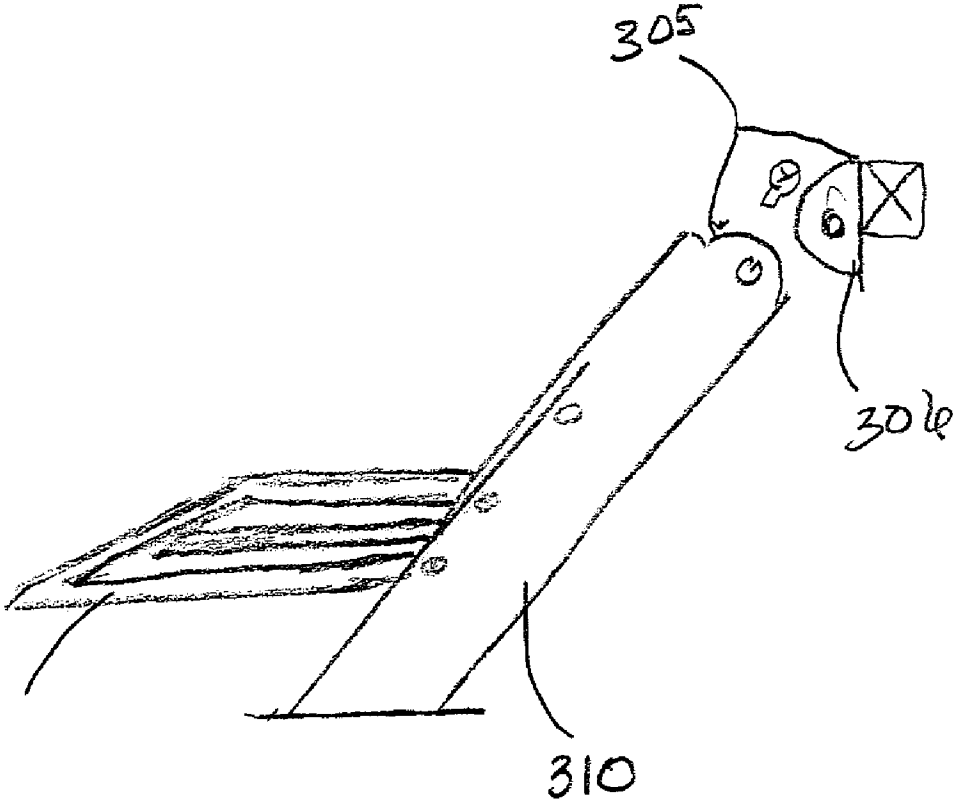
FIG. 6B is a side view of the bracket means of the step member.

Referring to FIG. 6, there is shown the preferred embodiment for step means (300) of the present invention. In the illustrated embodiment, the at least one step means (300) is securely and removably attached to the lower support frame (110) utilizing bracket means (305). The step means (300) further comprises two parallel ground engaging leg members (310) being a set distance apart and extending at an incline downward to the ground level. The bracket means (305) is integrated into the top end of each ground engaging leg member (310) and adapted to attach to external perimeter frame. Referring to FIG. 6B, there is shown an exploded side view of bracket means (305). Each bracket means (305) have an anchor (306) at its upper end which is adapted to connect to the rail member of external perimeter frame (116) as shown in FIG. 6.

In the illustrated embodiment in FIG. 6, the step means (300) further includes a plurality of step members (320). Each step member (320) is disposed between the two ground engaging leg members (310). Each step member (320) is situated at an equi-distance between the two ground engaging leg members (310) and is pivotally attached to the two ground engaging members (310).

Referring to FIG. 8, there is shown an alternative embodiment for step means (400) of the present invention. In the alternative embodiment, step means (400) is a handicap step member means. In this kind of embodiment, the at least one step means (400) are securely and removable attached to the lower support frame (115) utilizing bracket means (405). The step means (400) further comprises two parallel ground engaging leg members (410) being a set distance apart and extending at an incline downward to the ground level. The bracket means (405) is integrated into the top end of each ground engaging leg member (410) and is adapted to attach to the external perimeter frame (116) of the lower support frame structure (115). Each bracket means (405) have an anchor (406) at its upper end which is adapted to connect to the rail member of external perimeter frame (116). The step means (400) further includes an incline ramp member (430) disposed between the two ground engaging leg members (410). The incline ramp member (430) allows a handicap person in a wheel chair to ingress and egress onto the platform portion.

The deck (100) is adapted with disassembly means for completely disconnecting the deck (100) for easy storage. The attaching edges of each element of deck (100) are configured to be easily connected and disconnected from its counter element. The assembled base frame rail members can be easily unbolted and decoupled from each leg member. The upper support frame vertical rails can be decoupled from the lower support frame and each rail support panel can be unbolted from its two supporting vertical beams. The panels of the platform portion can be easily demounted from the lower support frame. The at least one step member can be unbolted from the lower support frame. After each element of the deck is disassembled, the disassembled deck can be stored in the trunk of a car.

Figure 9:
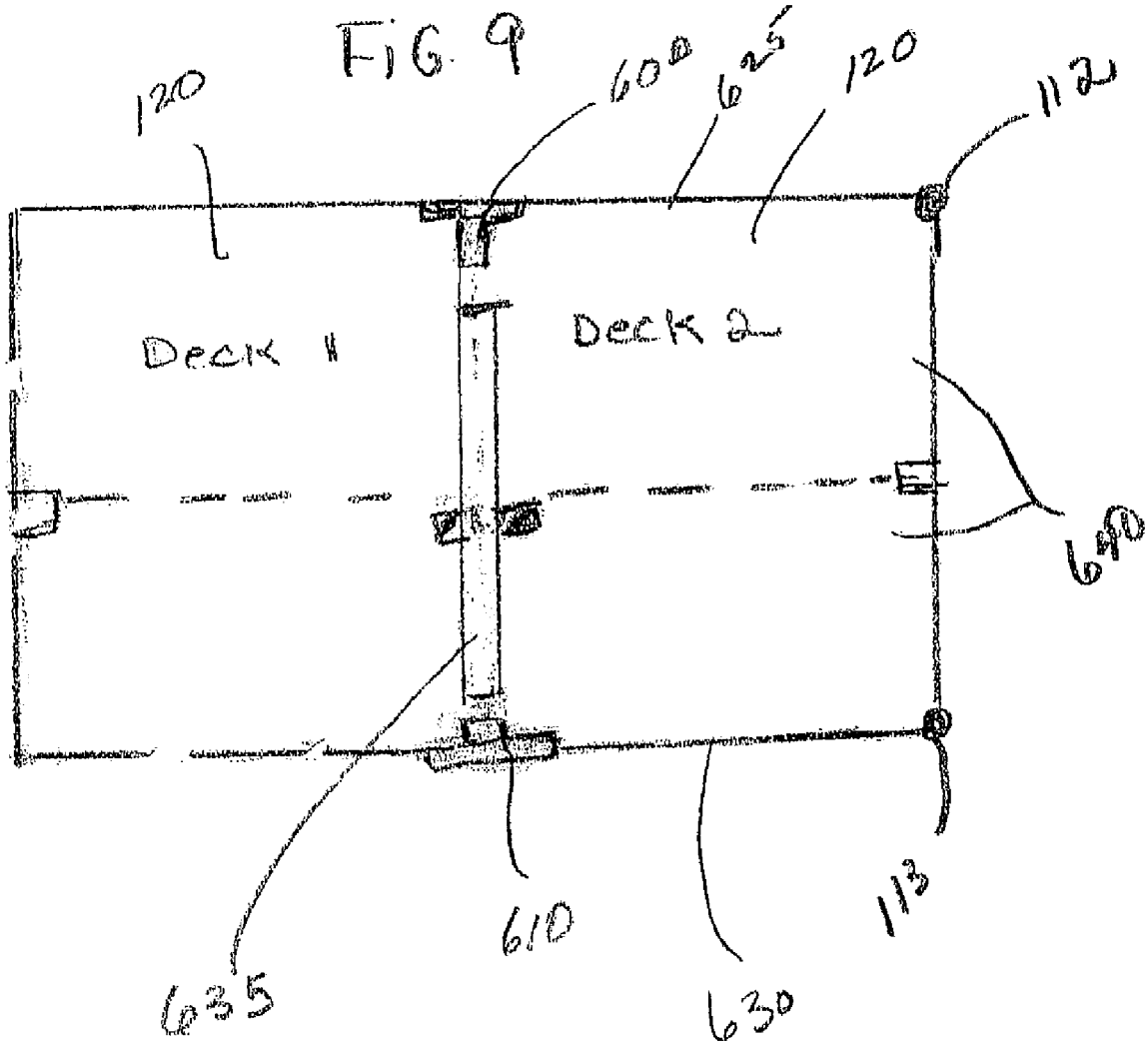
FIG. 9 is a top view of the platform portion being extended in length.

In alternative embodiments of the present invention, the platform portion can be extended. In order to extend the platform portion, the external perimeter frame of the lower support structure must be extended. Referring to FIG. 9, there is shown the platform portion (120) of one embodiment of the present invention doubled in length. In the illustrated embodiment, a first (600) and a second (610) T shape extension coupler are attached at opposite ends of the rectangular shape external perimeter frame (620). Then a first (625) and a second (630) extension rail member are respectively attached to the first (600) and second extension coupler (610). To form the external perimeter frame (620), the first extension rail member (625) is connected to elongated leg member (112) and the second extension rail member (630) is attached to the shorter leg member (113). In order to support the additional panels for the platform portion, the extended external perimeter frame is internally dissected into two additional receiving channels (640). The extended internal frame is formed by an additional rail member (635), which extends across the width of the external frame member and is removably connected with the first extension coupler (600) at one end and second extension coupler (610) at the opposite end. When deck (100) is extended, to provide the sturdiness required to securely hold the entire deck in place, a separate banister member doubled in length would to be required.

In alternative embodiments of the present invention, lower support frame can have the shape of other polygons. In those alternative embodiments the other elements of the deck (100) would have to be adjusted to fit the new shape of the polygon.

What is claimed is:

1. A free standing portable deck for use with recreational vehicles, the deck comprising:

a lower frame structure defined by a plurality of individually adjustable ground engaging elongated leg members with a distal end and a plurality of individually adjustable shorter ground engaging leg members with an upper end;

a plurality of individual elongated rail members;

the upper end of the shorter leg members and the distal end of the elongated leg members being removably interlocked to the opposing ends of a first subset of the plurality of elongated rail members such that a polygonal shape external perimeter frame with a predefined number of corners is assembled;

a second subset of the elongated rail members being removably disposed within the external perimeter frame to form an internal frame dissecting the external perimeter frame into a plurality of receiving channels;

the lower support frame structure being adapted to receive a flat planar platform portion within the receiving channels;

an upper support frame defined by a plurality of structural members removably coupled to the lower support frame wherein the upper support frame is adapted to secure the assembled deck firmly and fixably in place;

the upper support frame forming a partial enclosure of the external perimeter frame with a frontal opening for ingressing and egressing into the door of the recreational vehicle door and at least one side opening;

at least one step means for ingressing and egressing onto the platform portion, the at least one step means being removably coupled to the at least one side opening in the external perimeter frame;

a disassembly means for completely disconnecting the deck for easy storage;

and each shorter leg member having a first corner angle male coupling means fixably attached to its upper end;

each elongated leg member having a second corner angle male coupling means attached to a distal end, the second corner angle being fixably attached at a position equivalent to the height of each shorter leg member;

each corner angle being dimensioned according to a corresponding corner angle in the polygonal shape of the external perimeter frame;

each rail member in the external perimeter frame having a female coupling means at each opposite end;

each female coupling means being removably interlocked with a corresponding male coupling means such that the polygonal shape of the external perimeter frame is formed; and the first male coupling and the second male coupling further comprises two short protruding rods being securely connected together to form the corner angle.

2. The deck of claim 1 wherein the platform portion further comprises:

a plurality of side by side panels disposed across the width of the lower support frame structure;

each panel having a plurality of holding guide struts attached to an underside;

the holding guide struts being positioned and dimensioned for insertion into the receiving channels such that the outer peripheral edges of each panel removably interlock with the outer peripheral edges of an adjoining panel to form a secure flat continuous planar surface.

3. The deck of claim 2 wherein the panels are made of wood.

4. The deck of claim 2 wherein the panels are made of metallic mesh material.

5. The deck of claim 2 wherein the external perimeter frame is rectangular shaped and is dissected by the internal frame into two equivalent receiving channels.

6. The deck of claim 2 wherein the external perimeter frame is rectangular shaped and is dissected by the internal frame into four equivalent receiving channels.

7. The deck of claim 1 wherein the at least one step means is disconnected from the external perimeter frame.

8. The deck of claim 7 wherein the at least one step means further comprises:

a second lower support frame having a polygonal shape defined by a plurality of rail members;

a flat planar second platform portion being removably mounted upon the second lower support frame;

a plurality of second leg members corresponding to the number of corners in the shape of the second lower support frame; and each second leg member being disposed underneath the second lower support frame at each corner, each leg member being adapted to be removably coupled to each corner of the second lower support frame such that the second platform portion is held in a substantially level position at a predetermined height in relation to the ground level.

9. The deck of claim 8 wherein the second platform portion further comprises:

at least one panel being disposed across the width of the second lower support frame;

each panel having holding guide struts attached to an underside; and the holding guide struts being positioned and dimensioned to mount upon second lower support frame such that the at least one panel forms a flat planar surface.

10. The deck of claim 8 wherein each second leg member further comprises:

an adjustable slideably rail having an upper portion and a lower portion, the upper portion being adapted to telescope onto the lower portion, and a locking mechanism for holding the upper portion and the lower portion into a set position such that the adjustable rail is held at a height in relation to the ground level.

11. The deck of claim 1 wherein each shorter leg member and each elongated leg member further comprises:

an adjustable slideably rail having an upper portion and a lower portion, the upper portion being adapted to telescope onto the lower portion, and a locking mechanism for holding the upper portion and the lower portion into a set position such that the adjustable rail is held at a height in relation to the ground level.

12. The deck of claim 1 wherein the upper support frame further comprises:

a plurality of vertical rails, a one-piece banister structural member and a plurality of rail support panels;

each vertical rail being perpendicularly coupled to the external perimeter frame at a strategic location in parallel relation to an corresponding elongated leg member;

each vertical rail member and an corresponding elongated leg member extending linearly upward to a fixed length forming a plurality of structural beams;

the banister member having a partially enclosed polygonal shape corresponding to the external perimeter frame;

each corner of the banister structural member being adapted to be removably coupled to the upper end of each structural beam wherein the entire deck is securely held in place; and each rail support panel being disposed between two structural beams, each rail support panel being removeably connected at a substantially midpoint between the two structural beams whereby the upper support frame forms a partial enclosure of the external perimeter frame leaving at least one opening for ingress and egress onto the at least one step means.

13. The deck of claim 12 wherein each rail support panel further comprises a plurality of beams fixably interconnected into a pattern arrangement.

14. The deck of claim 13 wherein each rail support panel is configured with a predefined width for supporting the partial enclosure of the platform portion and a predefined width corresponding to the distance between the two vertical rails.

15. The deck of claim 12 wherein the banister member further comprises:

a short protruding rod at each corner of the polygon of the banister member; and the short protruding rod extending in a downward direction.

16. The deck of claim 15 wherein:

each structural beam have an internal bore at an upper end;

each elongated leg member having an internal bore at an upper end;

the internal bore of the structural beam and the elongated leg member dimensioned to engage with a corresponding protruding rod of the banister member such that the banister can be securely coupled to the structural beam and the elongated leg members.

17. The deck of claim 1 wherein the at least one step means further comprises:

two parallel ground engaging leg members being a set distance apart and extending at an incline downward to the ground level;

a bracket means integrated into the top end of each ground engaging leg member and adapted to attach to the external perimeter frame; and a plurality of step members, each step member being situated at an equidistance between the two ground engaging leg members and being pivotally attached to the two ground engaging members.

18. The deck of claim 1 further comprising means for extending the length of the platform portion.

19. The deck of claim 1 further comprising:

a first T shape extension coupler and a second T shape extension coupler, the first and second T coupler having a short linear member perpendicular attached a second member;

a first rail member extending vertically across the width of the external perimeter frame;

the first T coupler being removably coupled to a first end of the first rail member and the second T coupler being removably coupled to a second opposite end of the first rail member;

the external perimeter frame being defined by an upper external perimeter frame and a lower external perimeter frame;

a first extension rail member having a first end and an opposite second end;

a second extension rail member having a first end and an opposite second end;

the first end of the first extension rail member being removably connected to distal end of the elongated leg member and the first end of the second extension rail member being removably connected to the upper end of the shorter leg member;

the first T coupler interconnecting the upper external perimeter frame to the opposite second end of the first extension rail member;

the second T coupler interconnecting the lower external perimeter frame to the opposite second end of the second extension rail member such that an extended external perimeter is assembled;

a third subset of the elongated rail members being removably disposed within the extended external perimeter frame to form an internal frame dissecting the extended perimeter frame into additional receiving channels to support the extended dimensions of the platform portion.

20. The deck of claim 1 wherein the first and second male coupling are right angles.

21. The deck of claim 1 wherein the female coupling further comprises:

an internal bore formed at opposed ends and dimensioned to engage with the protruding rod of a matching male coupling, wherein the external perimeter frame is assembled into the corresponding polygonal shape; and a fastener adapted to secure to male coupling and female coupling in place.

* * * * *